United States Patent [19]

Peyre

[11] Patent Number: 5,044,656

[45] Date of Patent: Sep. 3, 1991

[54] SLIDEBOARD

[75] Inventor: Henri Peyre, Saint Benin D'Azy, France

[73] Assignee: Look S.A., Nevers, France

[21] Appl. No.: 501,691

[22] Filed: Mar. 29, 1990

[30] Foreign Application Priority Data

Jun. 9, 1989 [DE] Fed. Rep. of Germany ..... 3918939

[51] Int. Cl.[5] ..... A63C 9/08

[52] U.S. Cl. ..... 280/618; 280/637

[58] Field of Search ..... 280/618, 637, 14.2, 280/617, 620

[56] References Cited

U.S. PATENT DOCUMENTS

| | | | |
|---|---|---|---|
| 3,752,491 | 8/1973 | Fend | 280/618 |
| 3,825,274 | 7/1974 | Weinstein | 280/618 X |
| 3,871,674 | 3/1975 | Bunn, Jr. | 280/637 |
| 3,924,866 | 12/1975 | Schweizer | 280/637 |
| 3,936,066 | 2/1976 | Witting | 280/637 |
| 4,065,151 | 12/1977 | Weinstein | 280/618 |
| 4,142,735 | 3/1979 | Biermann et al. | 280/637 X |
| 4,165,887 | 8/1979 | Bunn, Jr. | 280/637 X |
| 4,652,007 | 3/1987 | Dennis | 280/618 |
| 4,741,550 | 5/1988 | Dennis | 280/618 |
| 4,955,632 | 9/1990 | Giarritta et al. | 280/14.2 X |

FOREIGN PATENT DOCUMENTS

| | | | |
|---|---|---|---|
| 270175 | 6/1988 | European Pat. Off. . | |
| 2828633 | 1/1980 | Fed. Rep. of Germany | 280/637 |

*Primary Examiner*—Andres Kashnikow
*Assistant Examiner*—Michael Mar
*Attorney, Agent, or Firm*—J. Georg Seka; Duane H. Mathiowetz

[57] ABSTRACT

A snowboard has two bindings for two boots (21) with the bindings being arranged at a substantial angle to the longitudinal axis (45). Each binding includes a board plate (17) secured to the board (11) and a boot plate (21) which is fixedly connectable to the boot (31). Both plates (17, 21) are drawn into firm contact with one another by resilient tensioning devices (24, 25, 26, 27) which are substantially centrally arranged in the front and the rear regions. The resilience of the resilient tensioning devices is so dimensioned that with excessive loadings of the legs of the user the boot plate (21) can turn relative to the board plate (17) to the side, to the front and to the rear and also about a vertical axis (33).

27 Claims, 15 Drawing Sheets

SLIDEBOARD

BACKGROUND OF THE INVENTION

The invention relates to a slideboard, in particular to a snowboard having two bindings for two boots, with the bindings being arranged behind one another and at a clear angle to the longitudinal axis. Such slideboards are also known as snowboards.

It is already known (EP-A-0 270 175) that the two bindings of such a slideboard are secured to the board at an angle of the order of magnitude of 90 degrees to the longitudinal direction of the board, with the front binding optionally having a somewhat smaller angle than 90 degrees to the longitudinal axis. With the previously known slideboard the boots are secured to two individual plates which are arranged on a board plate mounted on the board and are slightly pivotable about the longitudinal axis against rubber buffers. In this manner the user of the slideboard is intented to achieve an ideal standing position on the board.

Furthermore, plate safety bindings for snowboards are known (U.S. Pat. Nos. 4,652,007 and 4,741,550) in which the boots are arranged on plates which are releasably secured to the slideboard via safety jaws.

SUMMARY OF THE INVENTION

The object of the present invention is to provide a slideboard of the initially named kind in which the boots are firmly connected to the slideboard under all normal riding conditions, in which however a certain yielding of the boot mounting is ensured in the case of excessive loadings of the legs of the user in the sideways direction, in particular also to the front and to the rear and about a vertical axis, with this yielding being sufficient to avoid injuries, in particular injuries brought about by hard jolts, but, not however being so large that the boots can release from the board. After termination of the dangerous loading the boot should in particular automatically return into its normal position on the slideboard so that the ride can be continued without any need for manipulations at the bindings.

In order to satisfy this object the present invention provides that each binding includes a board plate secured to the slideboard and a boot plate which is firmly connectable with the boot; that both plates are drawn into firm contact with one another by resilient tension means which are in particular arranged in the front and rear regions and are preferably arranged substantially centrally or symmetrically to the central longitudinal axis; and that the resilience of the resilient tension means is so dimensioned that with excessive loadings of the legs of the user the boot plate can tilt clearly relative to the board plate, at least sideways, can preferably also tilt to the front and to the rear to a restricted extent, and can also expediently pivot by a restricted amount about a vertical axis.

The maximum sideways tilting angle $\alpha$ amounts to 15 to 45 degrees, expediently to 20 to 40 degrees, preferably to 25 to 35 degrees, and in particular to approximately 30 degrees. The maximum tilting angle $\beta$ to the front and/or to the rear amounts to 3 to 15 degrees, preferably to 4 to 10 degrees and in particular to approximately 5 degrees. Finally, the maximum pivot angle $\gamma$ about the vertical axis (33) amounts to 3 to 15 degrees, preferably to 4 to 10 degrees, and in particular to approximately 5 degrees.

The thought underlying the invention is thus to be seen in the fact that tilting or pivoting movements, which are however of restricted scope, are possible between the boot plate and the board plate and make it possible to damp loadings of the legs of the user, in particular jolt-like loadings, so that no injuries arise. It is important that during normal riding no displacement takes place between the boot plate and the board plate but rather only when some form of excessive loading arises which could lead to injury. After a tilting or pivoting movement has taken place during a heavy loading the boot plate automatically returns into its normal position so that the ride can at once be continued after a fall or other response of one of the two bindings.

As result of the embodiment of claim 5 the board plate can be secured to a board without problem in various defined angular positions.

The embodiment of claim 6 makes it possible to simultaneously use the central bolt as a guide for the rotation of the board plate about the vertical axis.

Furthermore, it is advantageous when, in accordance with claim 7, further pivotal guides are provided for the pivoting of the boot plate relative to the board plate.

The resilient tension means for the bindings of the slide board of the invention can, in a particularly advantageous practical embodiment, be formed in accordance with claim 8.

A simple adaptation of the bindings to various boot sizes can take place through the measures of claim 9.

BRIEF DESCRIPTION OF THE DRAWINGS

The invention will now be described in the following by way of example and with reference to the drawings in which are shown.

In all figures the same reference numerals designate components which correspond to each other.

Figure 1:
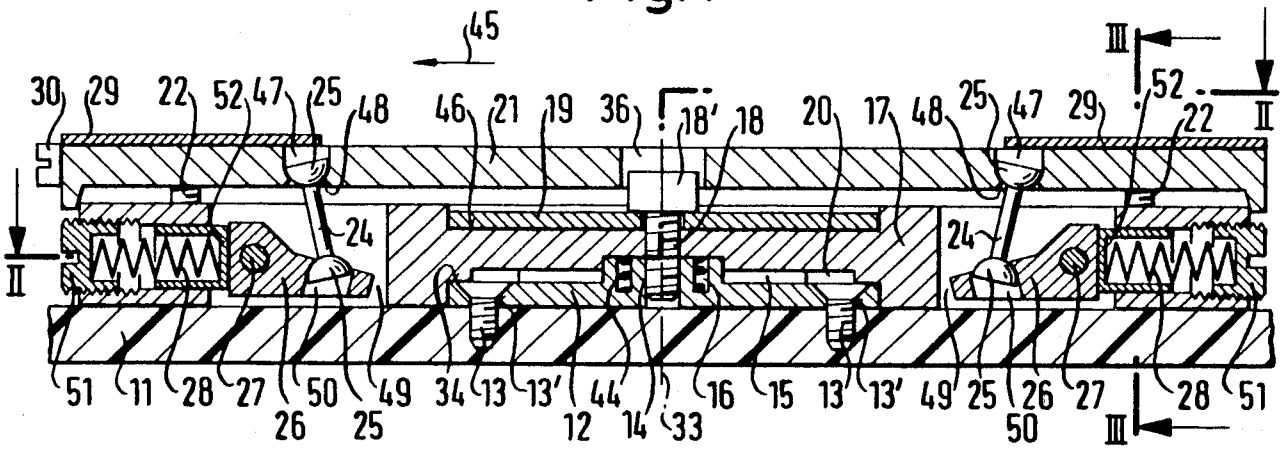
FIG. 1—a partly sectioned side view of a first embodiment of a binding for a slideboard in accordance with the invention, FIG. 2—a section on the line II-II in FIG. 1, FIG. 3—a section on the line III-III in FIG. 1, FIG. 4—side view of the boot plate 21 of a binding of the slideboard of the invention with the boot inserted, FIG. 5—a plan view of the boot plate in FIG. 4, FIG. 6—a view analogous to FIG. 1 with a boot plate tilted sideways towards the rear, FIG. 7—a section on the line VII-VII in FIG. 6, FIG. 8—a view analogous to FIG. 1 with the boot plate tilted forwardly relative to the board plate, FIG. 9—a plan view of the binding of FIG. 1 with the boot plate pivoted relative to the board plate in the clockwise sense about a vertical axis, FIG. 10—plan view of the holding disc of the binding of FIGS. 1 to 3, FIG. 11—a view of the board plate of the binding of FIGS. 1 to 3 from below, FIG. 12—a plan view of the boot plate of the binding of FIGS. 1 to 3 broken away in two places to illustrate the manual operation of the adjustment screw, FIG. 13—a partly sectioned side view of a further embodiment of a binding for a slideboard in accordance with the invention, FIG. 14—a view on the line XIV-XIV in FIG. 13, FIG. 15—a view on the line XV-XV in FIG. 13, FIG. 16—a partly sectioned side view of a further embodiment of a binding for a slideboard in accordance with the invention, FIG. 17—a section on the line XVII-XVII in FIG. 16, FIG. 18—a side view analogous to FIG. 16 with the boot plate tilted sideways, FIG. 19—a section on the line XIX-XIX in FIG. 18, FIG. 20—a corresponding side view to that of FIG. 16 with the boot plate tilted forwardly relative to the board plate, FIG. 21—a plan view of the binding of FIG. 16 with the boot plate twisted somewhat about the vertical axis relative to the board plate 17, FIG. 22—a section analagous to FIG. 17 of a further embodiment, FIG. 23—the same section with the boot plate tilted sideways, FIG. 24—a section analogous to FIG. 16 of a further embodiment, FIG. 25—the same section as FIG. 24 with the boot plate tilted sideways, FIG. 26—a section analogous to FIG. 17 of a further embodiment, FIG. 27—the same section as FIG. 26 with the boot plate tilted sideways, FIG. 28—a view of the board plate of the binding of FIG. 16 from below, FIG. 29—a partially sectioned side view of the subject of FIG. 28, FIG. 30—a view of the holding disc of the binding of FIG. 16 from above, FIG. 31—a partly sectioned view in accordance with FIG. 17, FIG. 32—a section on the line XXXII-XXXII in FIG. 31, FIG. 33—a modification of the embodiment of FIG. 31, FIG. 34—a section on the line XXXIV-XXXIV in FIG. 33, FIG. 35—a partly sectioned side view of a further embodiment of the binding of a slideboard in accordance with the invention, and FIG. 36—a sectional view on the line XXXVI-XXXVI in FIG. 35.
Figure 2:
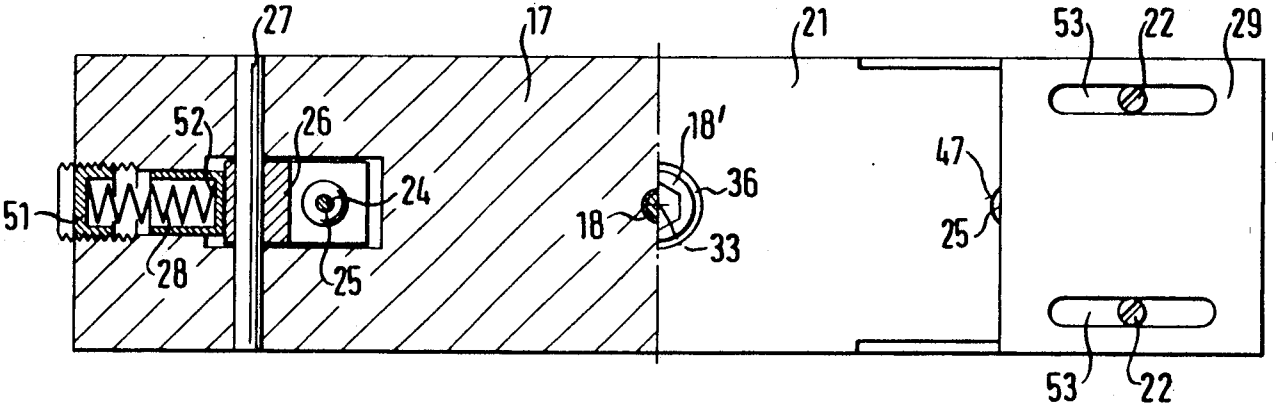
Figure 3:
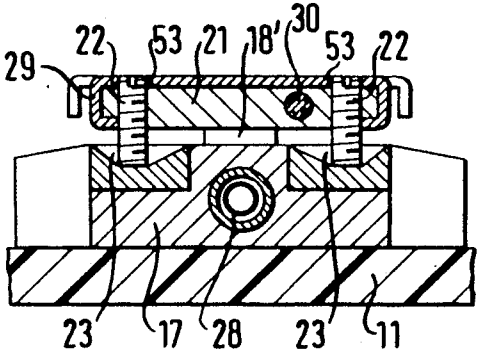

In accordance with FIGS. 1 to 3 a circular holding disc 12 is secured with fastening screws 13 to a snowboard 11 the longitudinal direction of which stands approximately perpendicular to the plane of the drawing of FIG. 1. At its centre the circular holding disc 12 has a threaded bore 14 coaxial to which there is provided a cylindrical spring accomodating chamber 16 in which a pretensioned compression coil spring 44 is arranged.

Figure 10:
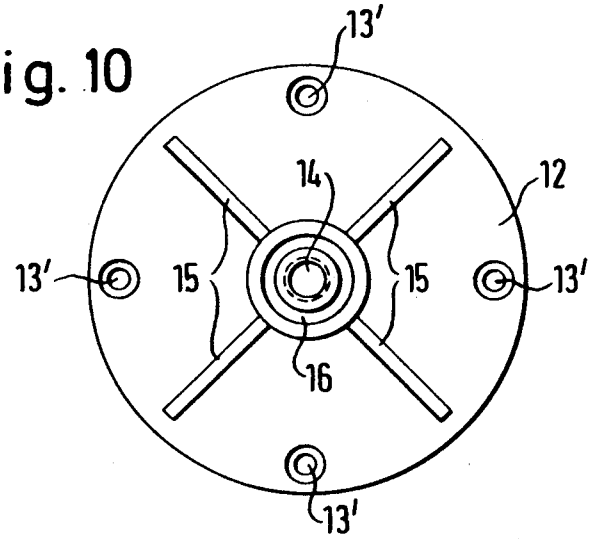

At its upper side the holding disc 12 has, in accordance with FIG. 10, four rib-like projections 15 which extend radially at angles of 90 degrees. Moreover, holes 13' are provided for the fastening screws 13.

Figure 11:
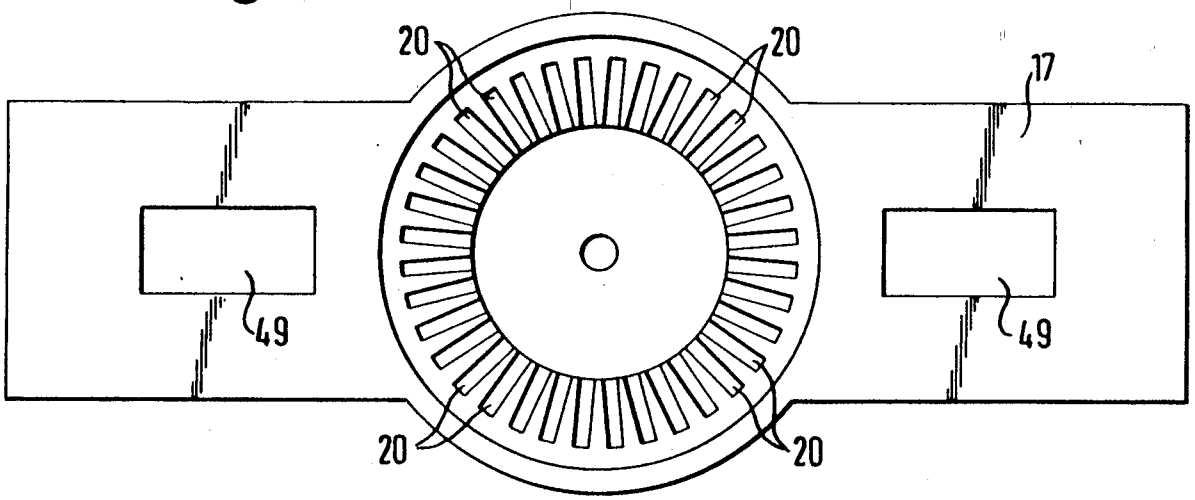

A board plate 17 which extends in the longitudinal direction of the boot 45 is fixedly screwed to the holding disc 12 and thus to the snowboard 11 by means of a central bolt 18. At its lower side the board plate 17 of FIG. 11 has radial recesses 20 which are arranged on a circle and which have an angular spacing of 10 degrees. The radial projections 15 of the holding disc 12 can engage into the recesses 20 from below resulting in a form-locked latched arrangement. A large area washer 19 is arranged in a recess 46 between the head 18' of the central bolt 18 and the surface of the board plate 17. The compression coil spring 44 which is located in the spring accomodating chamber 16 is braced at the bottom against the holding disc 12 and presses from beneath against the board plate 17. In this manner it is possible by loosening the central bolt 18 to lift the board plate 17 somewhat until the radial projections 15 move out of engagement with the radial depressions 20, whereupon the board plate 17 can then be rotated into the desired position and can then be screwed fast again to the board 11 by renewed tightening of the central bolt 18.

Above the board plate 17 there is provided a boot plate 21 which extends parallel to and substantially in alignment with the board plate 17. At its front and rear regions the boot plate 21 has guide spigots 22 which have been screwed into the boot plate 21 from above and which project downwardly. In accordance with FIGS. 3 and 9 these guide spigots 22 engage from above into part-circular peripheral recesses 23 of the board plate 17. The centre point of the circular peripheral cutouts 23 lies on the vertical axis 33 which also represents the central axis of the central bolt 18 and of the threaded bore 14.

In accordance with FIG. 3 the base of the peripheral recesses 23 rises slightly to both sides starting from the illustrated normal position.

Connecting spigots 24 with partly spherical heads 25 at both ends also extend between the board plate 17 and the boot plate 21 in the front and rear regions, however in each case at a larger spacing from the plate ends than the guide spigots 22. The upper partly spherical heads 25 are arranged in complementary spherically shaped recesses 47 of the boot plate 21, with the connecting spigots 24 being lead downwardly into a hollow cavity 49 of the board plate 17 by a bore 48 which adjoins the recess 47 at the bottom. The lower partly spherical heads 25 are arranged in corresponding complementary recesses of pivotable cams 26 which are pivotally secured to the board plate 17 about transverse axles 27 and which are acted on at the side of the pivot axle 27 remote from the recesses 50 by a release spring 28 which is arranged in a hollow cavity of the board plate 17 parallel to the longitudinal direction 45, with the spring being braced at the side remote from the pivotable cam 26 against an adjusting screw 51 which is accessible from the outside. A flat abutment 52 at the inner end of the release spring 28 acts against a corresponding flat side of the pivot cams 26 whereby these are held in the position which can be seen from FIGS. 1 to 3.

Figure 4:
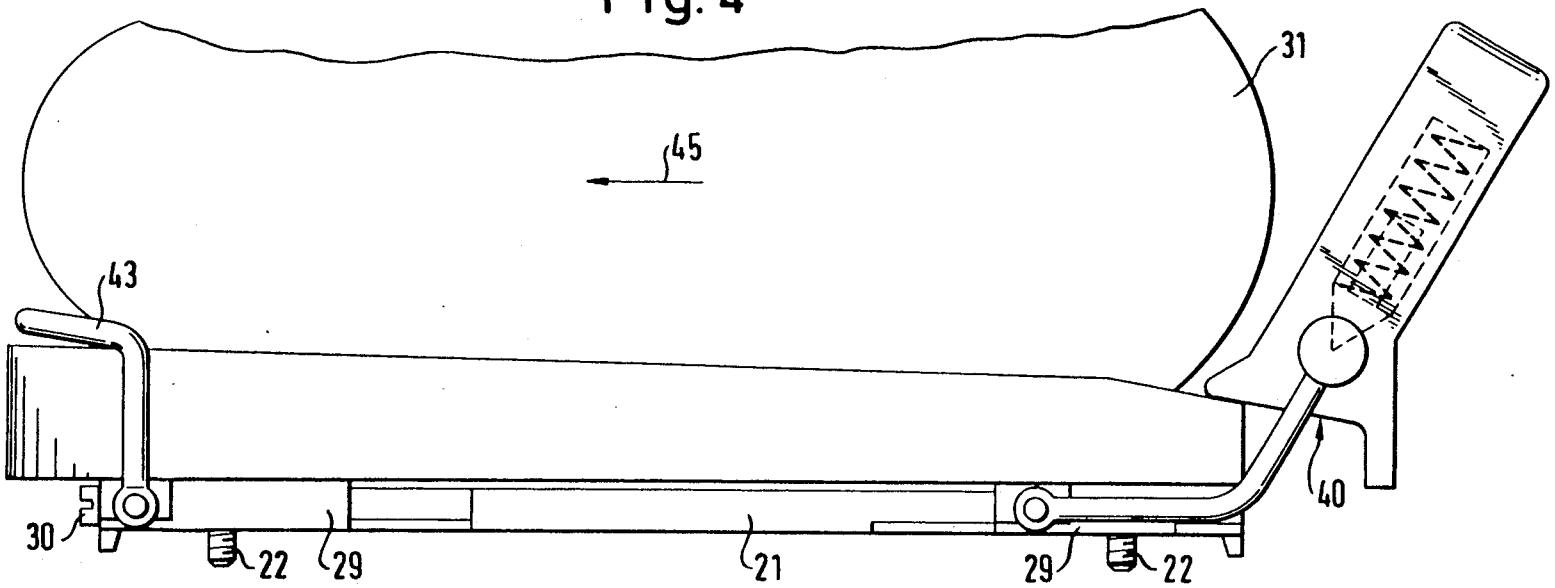

In accordance with FIG. 4 a boot 31 is arranged on the boot plate 21 and is held in firm connection with the boot plate 21 by a front boot holding means 43 in the form of a hoop and by a rear boot holding means 40 in form of a releasable hold-down clamp.

Figure 5:
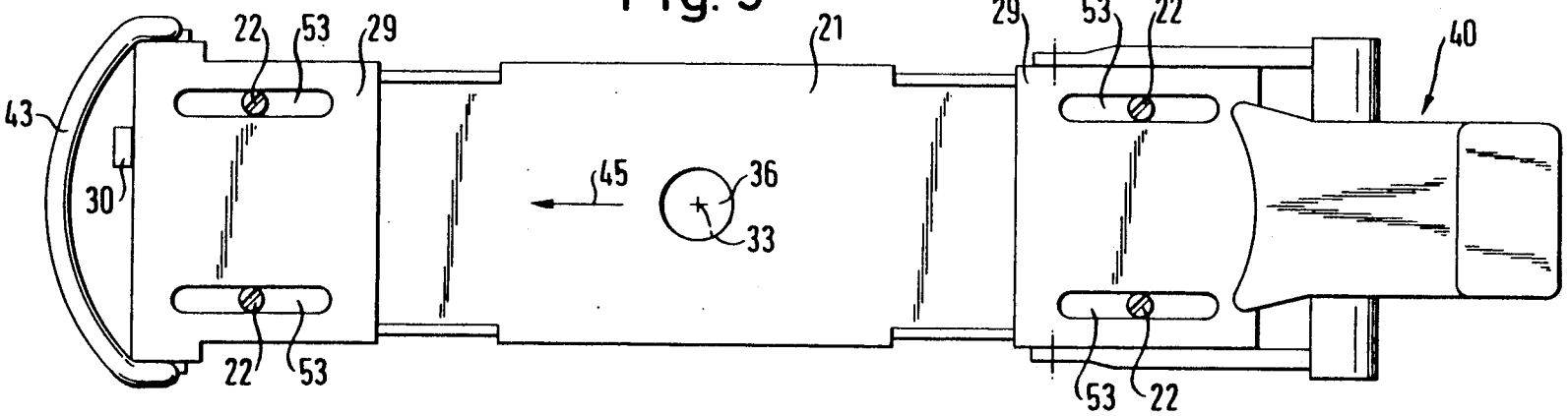
Figure 12:
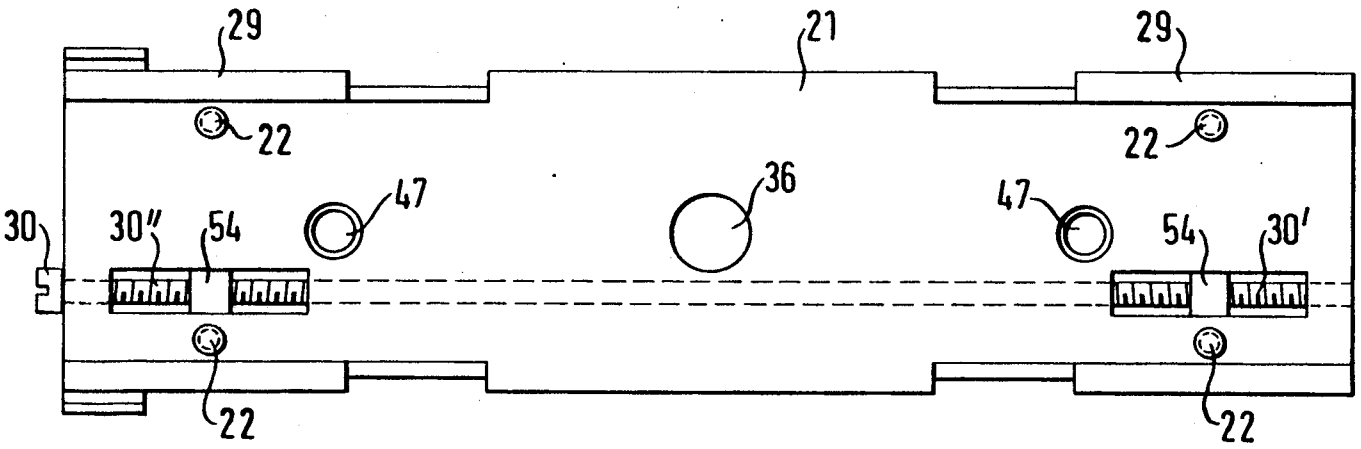

In accordance with FIGS. 4, 5 and 12 slide plates 29 are provided at the front and rear ends of the boot plate 21 and are displaceable in the longitudinal direction 45. The slide plates 29 have elongate slots 53 at the side through which the screw driver slots of the guide spigots 22 are accessible so that these can be rotated up to the desired degree of the projection from the lower side of the boot plate 21. In this way a desired basic position of the boot plate 21 on the board plate 17 can be set.

As seen in FIG. 12 an adjusting screw 30 extends through the boot plate 21 from the front to the rear. In the region of the rear slide plate 29 it has a right hand thread 30' and in the region of the front slide plate 29 it has a left hand 30'', with these threads cooperating with corresponding threads in nuts 44 of the slide plates 29.

The adjusting screw 30 is accessible from the front so that by inserting a screw driver into the screw driver slot which is provided there it is possible to rotate the adjusting screw 30 and thus to bring about a mutual and opposite adjustment of the slide plates 29.

It should also be pointed out that the outer peripheral region of the holding disc 12 engages from below into a ring recess 34 of the board plate 17 (FIG. 1).

Figure 6:
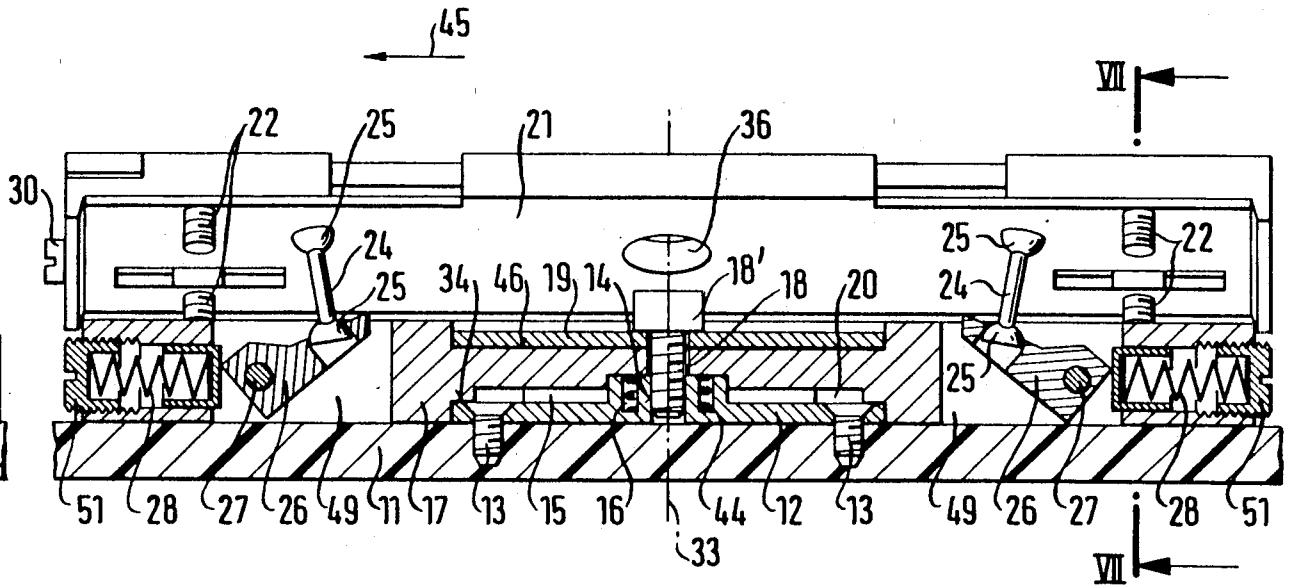
Figure 7:
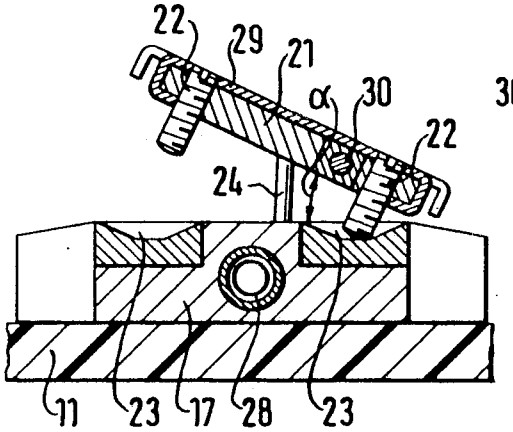

It can be seen from FIGS. 6 and 7 how the binding of FIG. 1 can tilt sideways through an angle $\alpha$ when excessive forces act on the leg of the user. The pivot cams 26 are pivoted upwardly via the connecting spigots 24 whereby the release springs 28 are correspondingly compressed. During this the right hand guide spigots 22 are braced against the base of the corresponding peripheral recesses 23.

Figure 8:
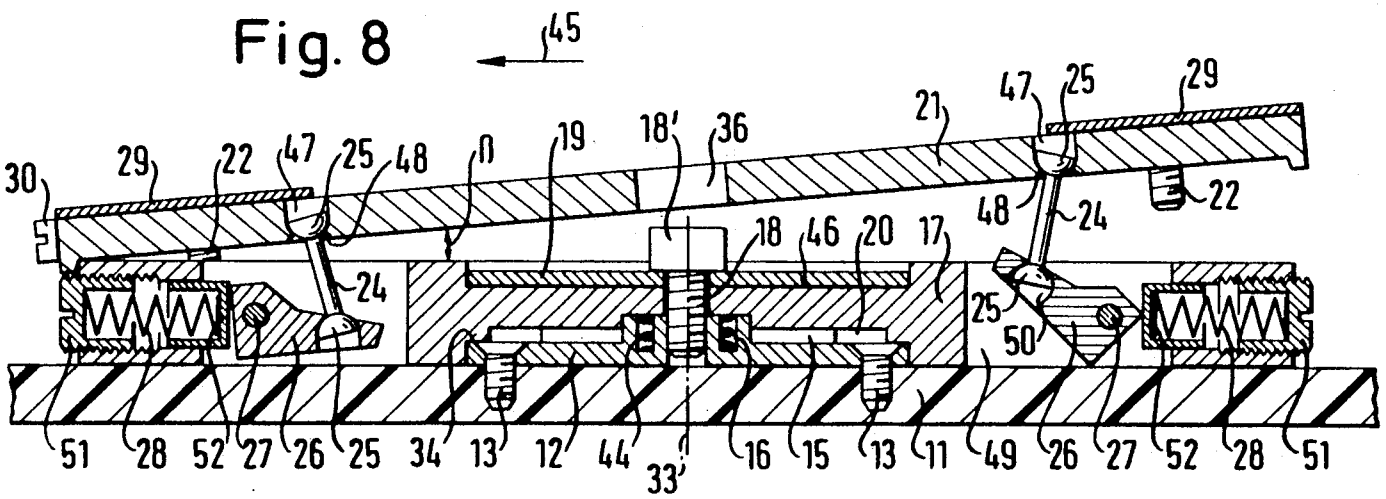

FIG. 8 shows how the boot plate 21 tilts when a forwardly directed tilting force acts on the boot (not illustrated) arranged on the boot plate 21. The tilting angle $\beta$ is here admittedly smaller than the tilting angle $\alpha$ of FIG. 7, however this yielding is sufficient to damp dangerous jolts.

Figure 9:
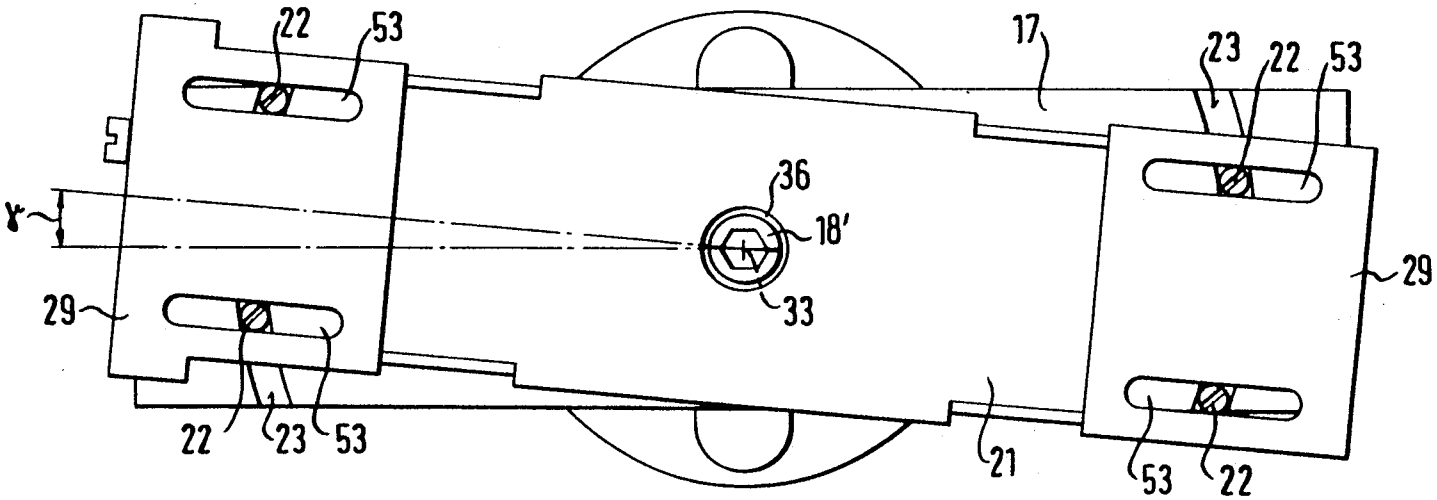

FIG. 9 finally shows how the boot plate 21 pivots relative to the board plate 17 about the vertical axis 33 when a jolt-like and dangerous torsional moment acts on the boot. The plates can thereby resiliently pivot relative to one another through an angle $\gamma$ of ca. 10 degrees, with the boot plate 21 being rotationally guided via the guide spigots 22 in the peripheral recesses 23 and by the head 18' of the central bolt 18 in the central bore 36 of the boot plate 21.

Since, during torsion of this kind, the guide spigots 22 of FIG. 3 contact the obliquely rising regions of the peripheral recesses 23 an additional tensioning of the pivot cam 26 takes place in this way so that the resetting moment is correspondingly increased.

Figure 13:
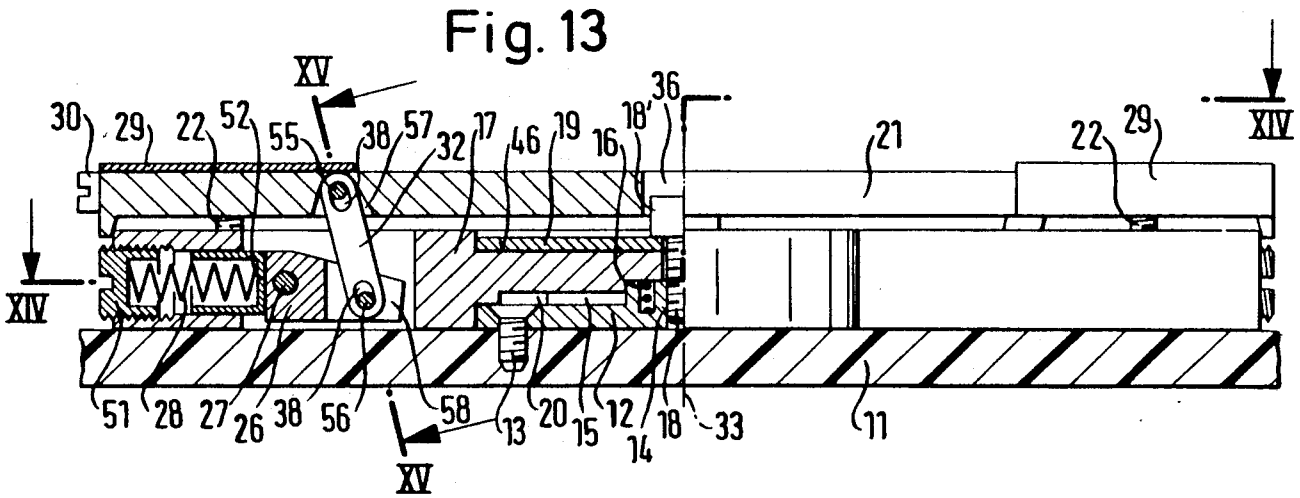
Figure 14:
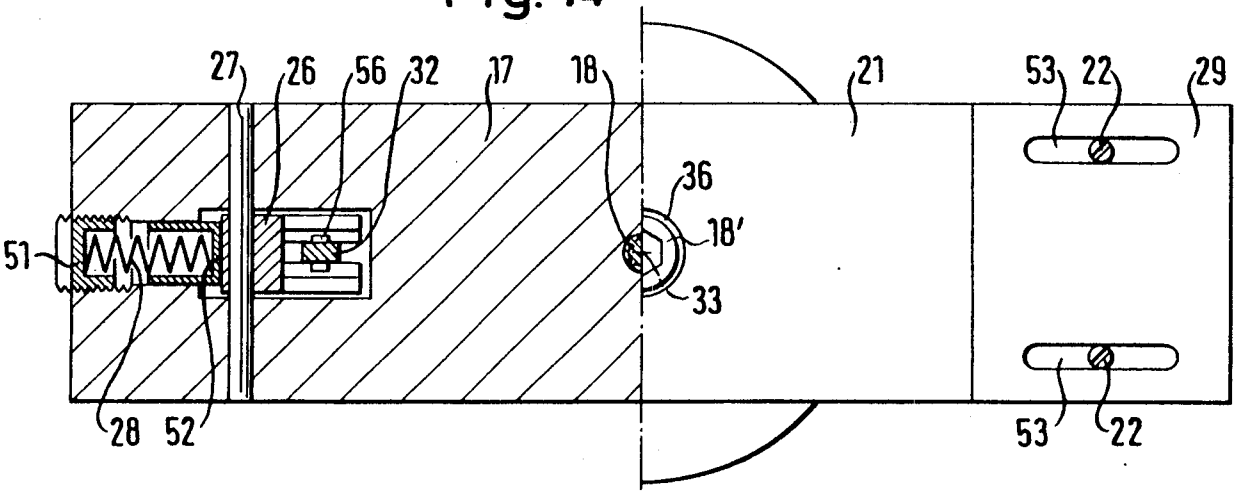
Figure 15:
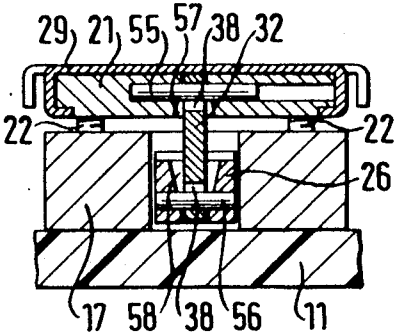

The embodiment of FIGS. 13 to 15 is distinguished from that of FIGS. 1 to 3 solely in that in place of the connecting spigots 24 with the partly spherical heads 25 there are provided flat links 32 with elongate slots 38 at both ends into which transverse spigots 55 and 56 of the boot plate 21 and of the pivot cam 26 respectively engage. Around the ends of the connecting links 32 there are provided respective upwardly and downwardly broadened recesses 57, 58 so that the links 32 can be pivoted relative to the boot plate 21 and relative to the pivot cam 26 both in the sideways direction and also towards the front and the rear. The movability thus corresponds to that of the connecting spigots 24 of FIG. 1.

The embodiment of FIGS. 16 to 19 shows a further possibility for the resilient safety connection of the board plate 17 with the boot plate 21.

Figure 16:
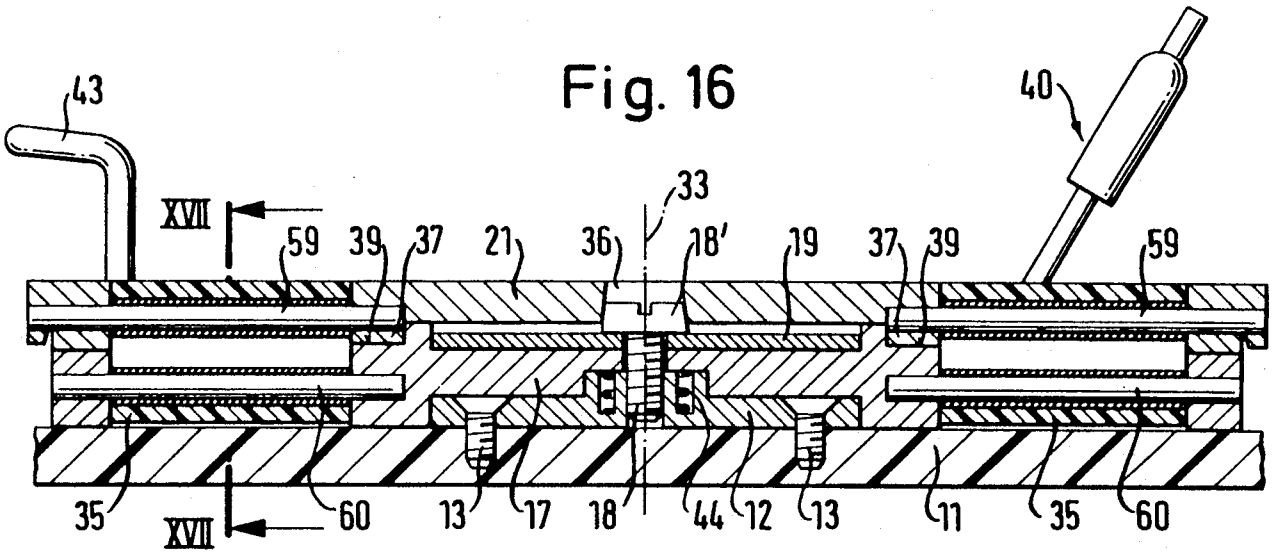
Figure 17:
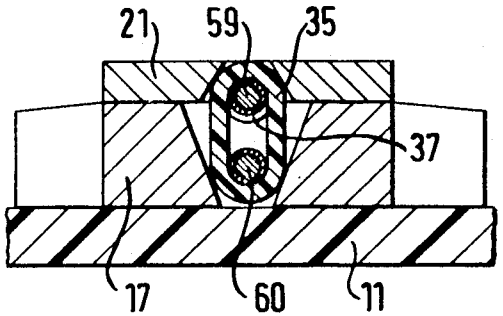

Here elastic bands 35 are provided which are slung around the longitudinal pins 59, 60 in the boot plate 21 and in the board plate 17 and which normally hold the boot plate 21 in the position which is evident from FIGS. 16 and 17. In the case of lateral tilting moment the boot plate 21 can tilt sideways analogously to the embodiment of FIGS. 6, 7 with resilient extension of the elastic bands 35.

Figure 19:
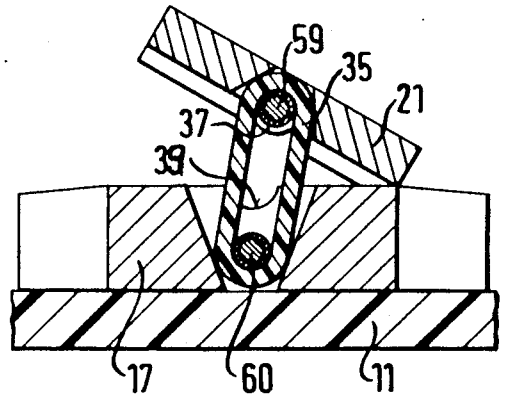

For the purpose of rotary guidance of the boot plate 21 the head 18' of the central bolt 18 again engages into the central bore 36 of the boot plate 21. In addition guide projections 37 are provided at the lower side of the boot plate 21 at a substantial radial distance from the central vertical axis 33, however still inside the elastic bands 35 and these guide projections 37 engage from above into recesses 39 which are also represented in FIG. 19. These recesses 39 represent latch recesses for the guide projections 37 out of which they can at least partly move during a torsional loading in accordance with FIG. 21, with the elastic bands 35 being correspondingly tensioned.

Figure 18:
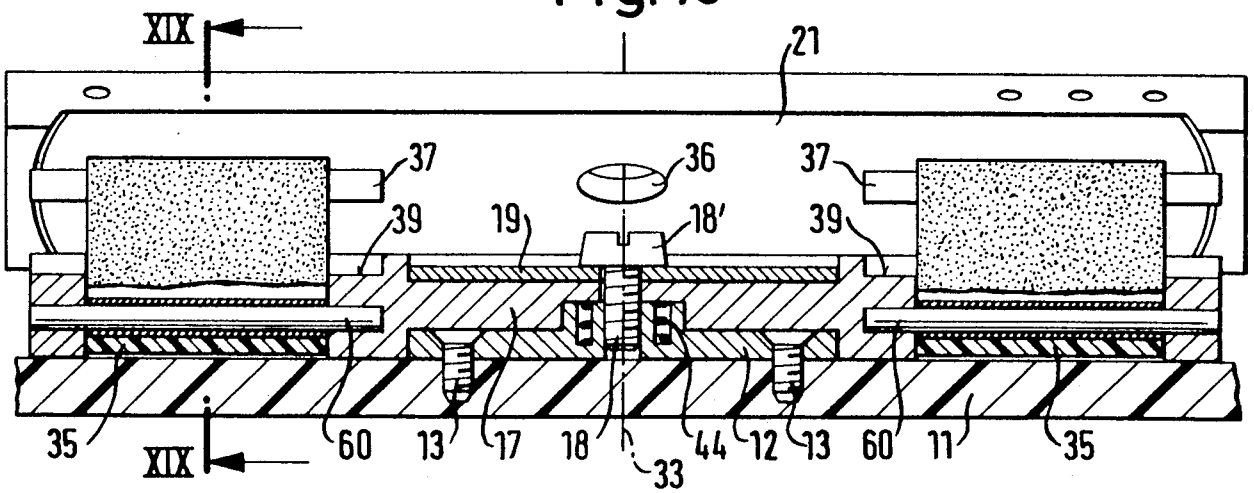
Figure 20:
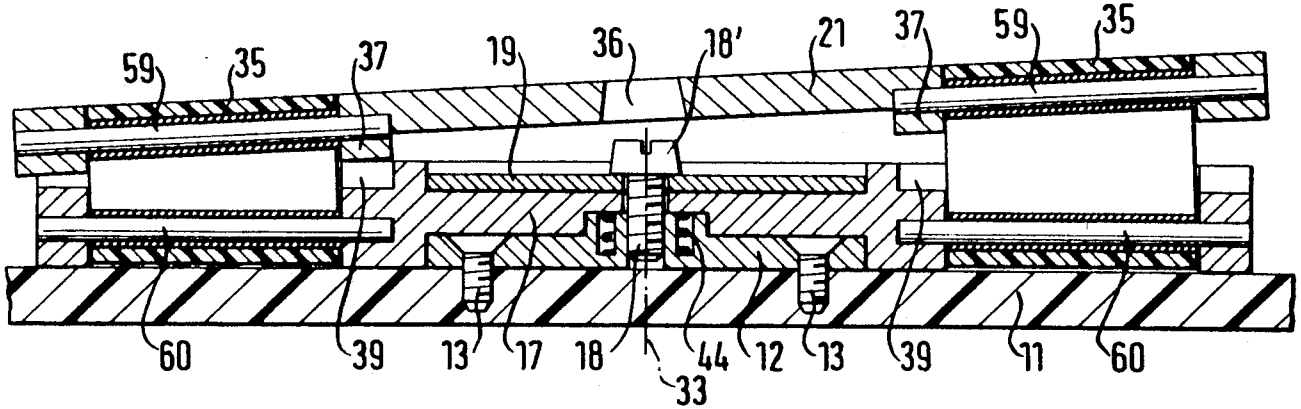

Whereas FIGS. 18 and 19 show the sideways resilient tilting of the boot plate 21 FIG. 20 shows how the elastic bands 35 deform when the boot plate 21 is tilted towards the front.

Figure 21:
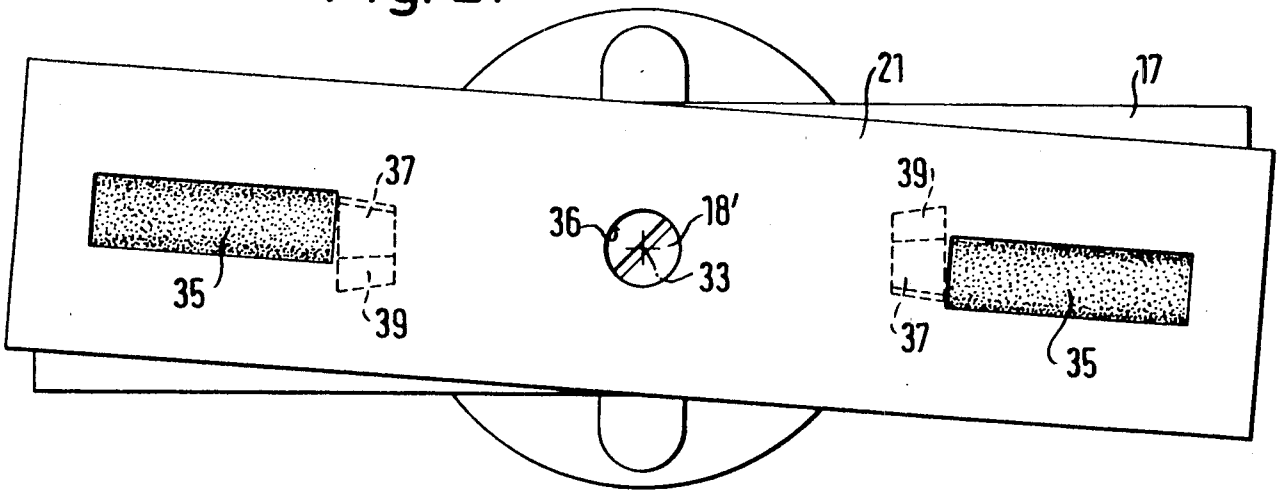
Figure 23:
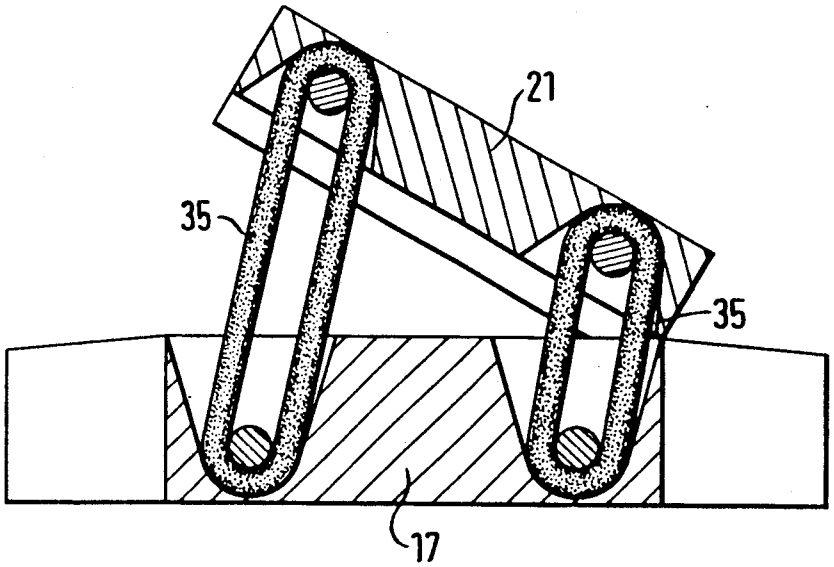
Figure 22:
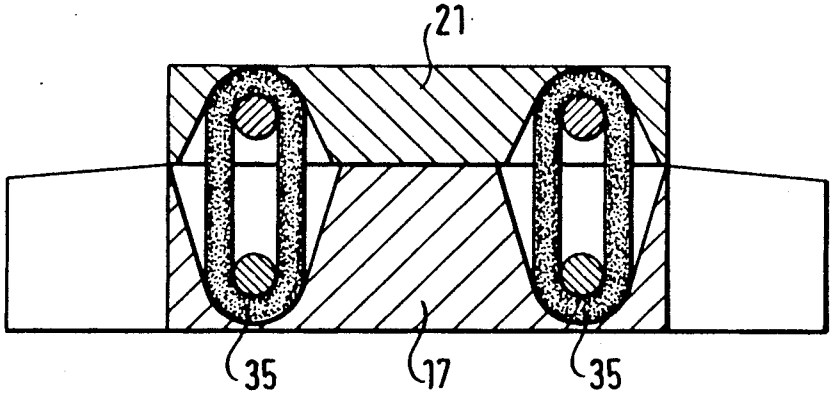

In place of a central double elastic band 35 in accordance with FIGS. 16 and 21 elastic bands 35 formed as closed loops can also be provided at each side of the central longitudinal axis of the two plates 17, 21.

Figure 25:
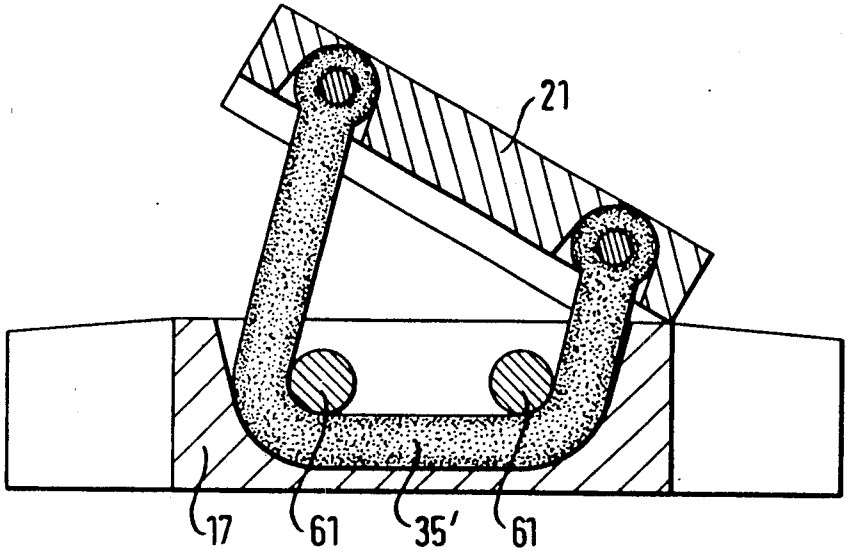
Figure 24:
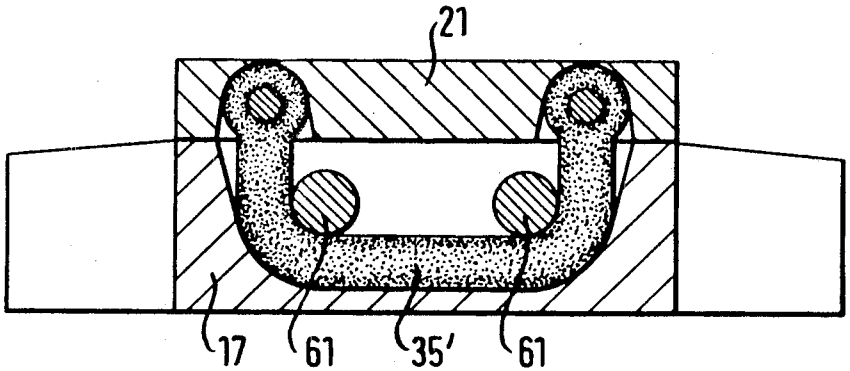

FIGS. 24 and 25 show how it is possible, with a single elastic band 35' which is guided around axial guide spigots 61 of the board plate 17, to realize points of action on the boot plate 21 which lie relatively far outboard.

Figure 27:
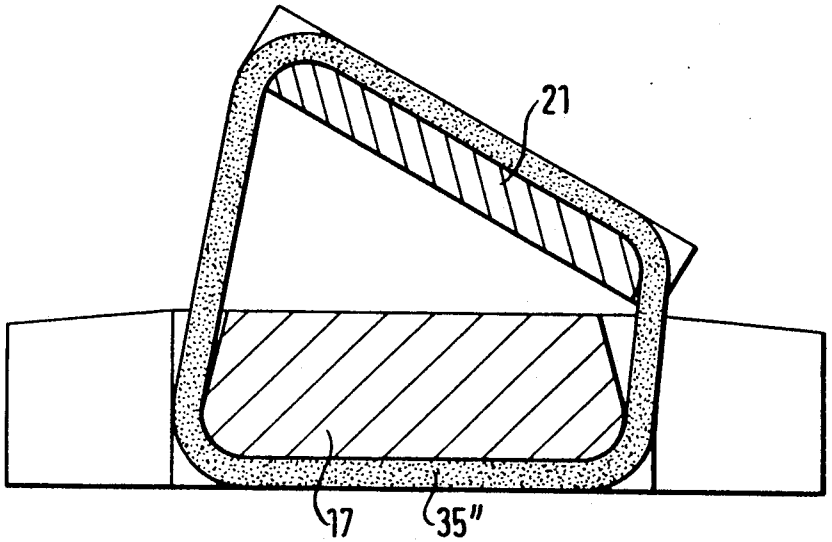
Figure 26:
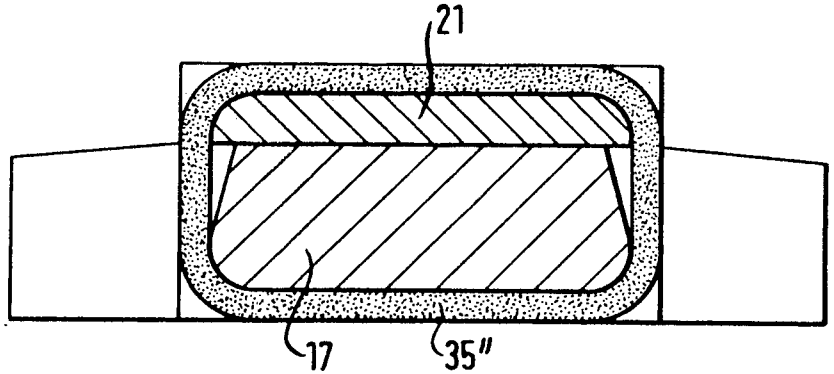

As seen in FIGS. 26 and 27 one elastic band 35'' surrounds the whole of the board plate 17 and the boot plate 21 in a specific region in front of and behind the vertical axis 33. In this way it is possible to realize a resilient tilting in accordance with FIG. 27, in just the same way as tilting to the front or to the rear, or a torsional movement.

Figure 28:
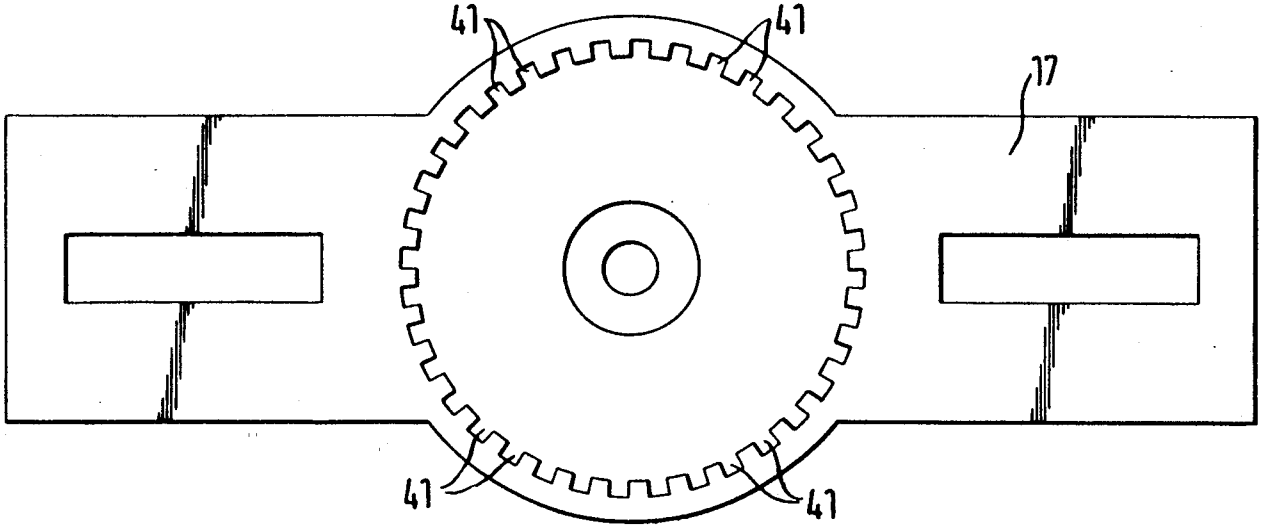
Figure 29:
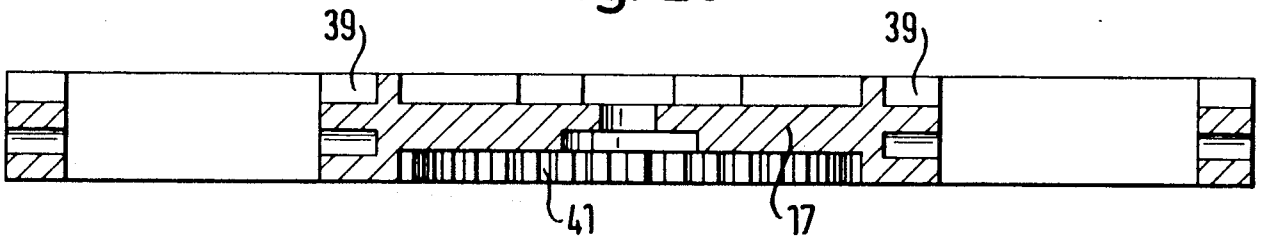
Figure 30:
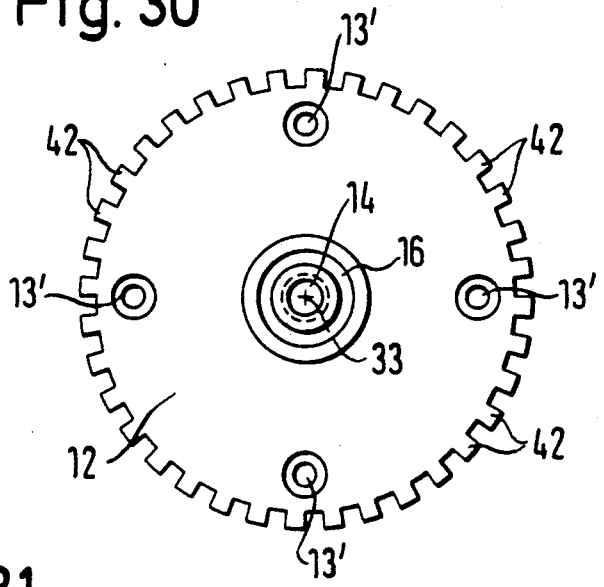

In the embodiment of FIG. 16 peripheral teeth 42 are provided (FIG. 30) radially outwardly on the circular holding disc 12. These peripheral teeth 42 cooperate in accordance with FIGS. 28, 29 with peripheral recesses 41 which are provided radially inwardly on the lower side of the board plate 17, in that the peripheral teeth 42 engage, depending on their pivotal position, in associated peripheral recesses 41.

Figure 31:
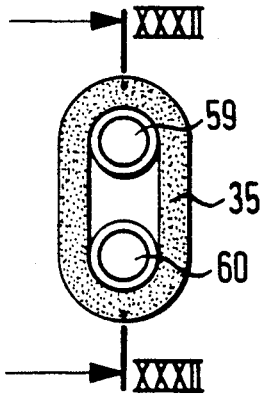
Figure 32:
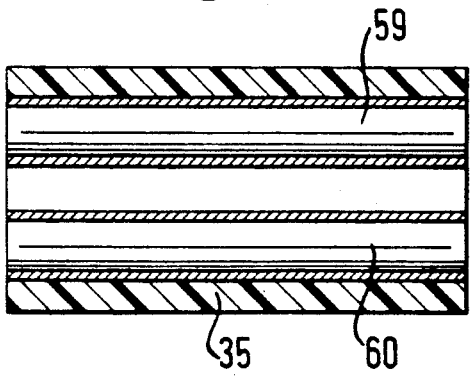
Figure 33:
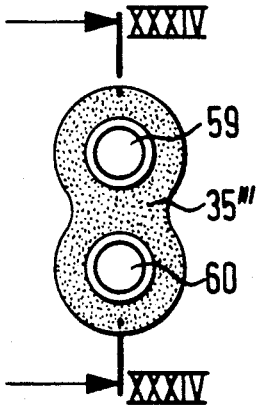
Figure 34:
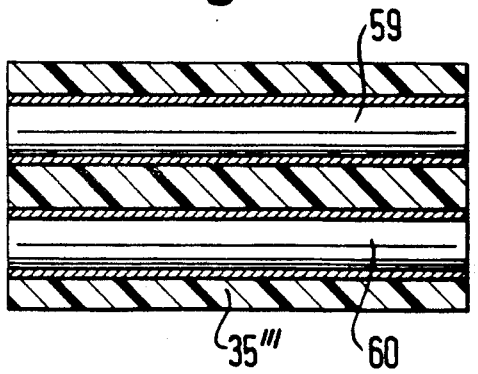

With regard to FIGS. 31, 32 on the one hand and FIGS. 33, 34 on the other hand it is shown how in place of looplike elastic bands 35 which are guided around the longitudinal pins 59, 60 it is also possible to use blocklike resilient bodies 35''', providing these have adequate elasticity. The longitudinal pins 59, 60 extend in the longitudinal direction through the elastic bodies 35'''.

Figure 35:
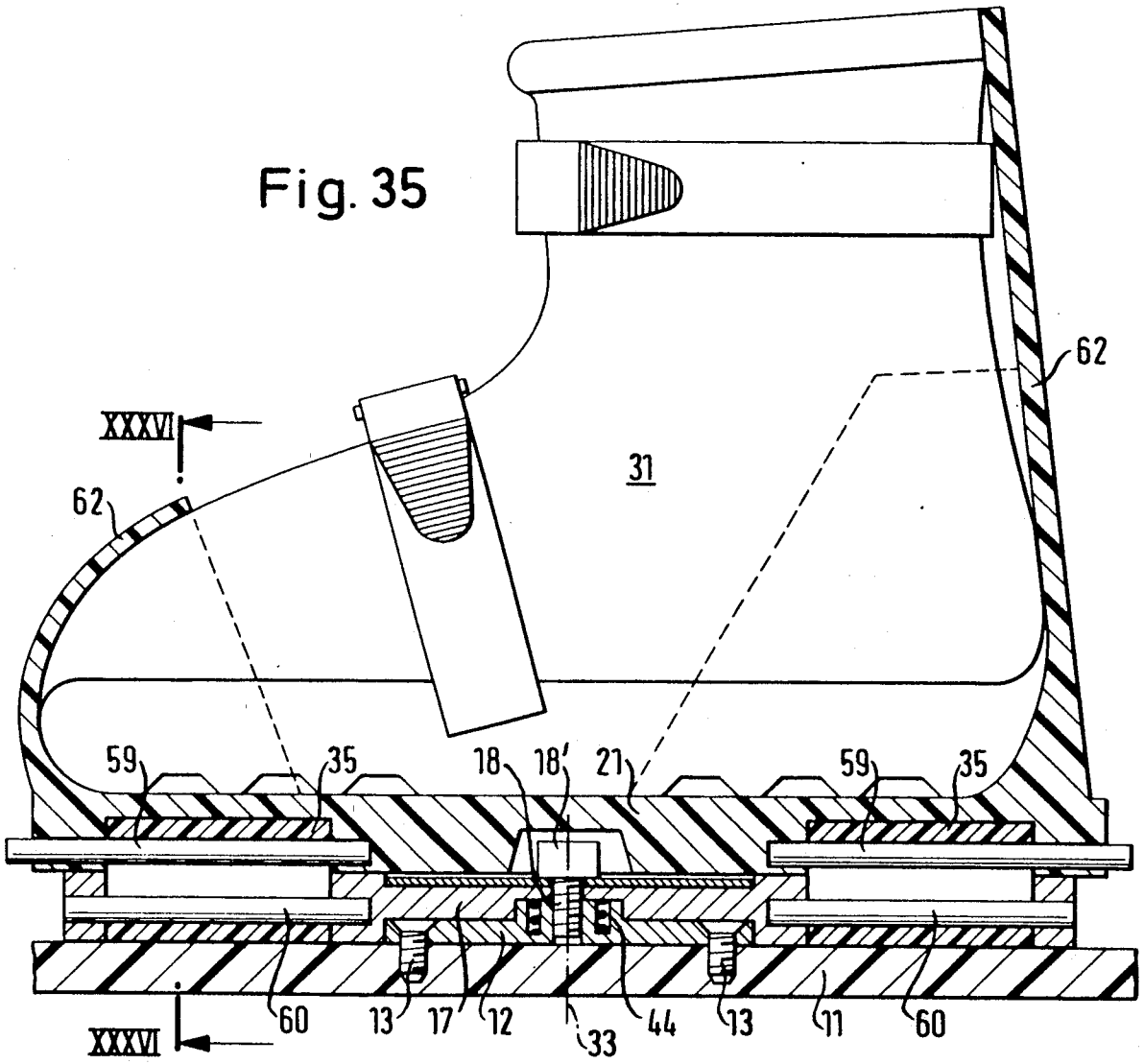
Figure 36:
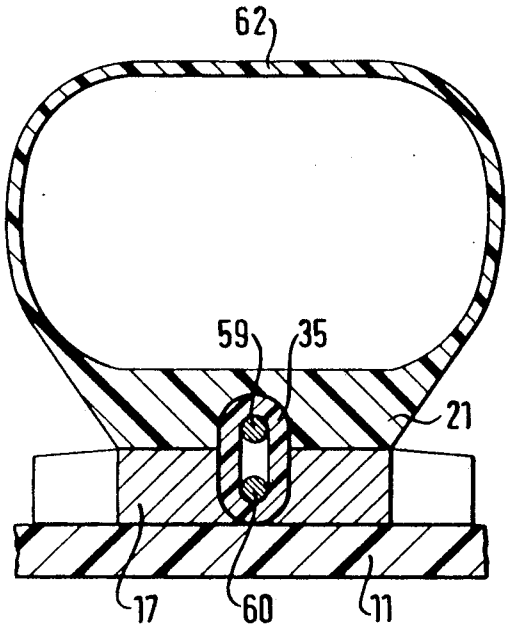

FIGS. 35 and 36 show a binding analogous to FIG. 16 in which however the boot 31 is inserted into a resilient holder 62 which represents an integrated component of the boot plate 21. The holder 62 can have further non-illustrated boot holding means which releasably secure the boot 31 to the boot plate 21.

In accordance with a further alternative the holder 62 can form an integral component of the boot 31 which is thereby constructionally united with the boot plate 21. In this case the boot plate 21 must be releasable from the board plate 17, for example by extractable longitudinal pins 59. It is of particular advantage that the inclination of the guide plate 21 in the embodiment of FIGS. 1 to 15 can be adjusted in desired manner by means of the guide spigots 22 which can be screwed in from above.

It is possible to do away with the adjustment means 29, 30, 30', 30' shown in FIG. 12 when a boot is used having a special unitary sole which is used for all boot sizes and is fixable by front and rear boot holding means to the boot plate 21.

I claim:

1. A slideboard comprising a board and first and second bindings for boots with the bindings arranged one behind the other at a substantial angle to the longitudinal axis of the board, each binding including a board plate secured to the board and a boot plate which is movable relative to the board plate and firmly connectable with the boot, resilient tensioning means for resiliently drawing said board plate and said boot plate into firm contact with one another in a front region and a rear region of the binding, said tensioning means generating a resilient force so that an excessive loading of the boot can cause tilting movements of the boot plate relative to the board plate in lateral and longitudinal directions about a lateral axis of the board plate and a longitudinal axis substantially perpendicular thereto, respectively, a circular holding disc secured to the board, a central bolt releasably securing said board plate to said holding disc, the board plate centrally pivotable about a vertical axis and having a ring recess of complementary shape to and accommodating said holding disc, opposing surfaces of the board plate and the holding disc defining cooperating radially oriented projections and recesses at predetermined angular spacings about the vertical axis for locking the board plate with the bolt to the holding disc in a chosen one of predetermined angular positions determined by the cooperating projections and recesses.

2. A slideboard in accordance with claim 1 in which the predetermined angular spacings of at least one of the projections and recesses are about 5 to 15 degrees.

3. A slideboard in accordance with claim 1 in which the predetermined angular spacings of at least one of the projections and recesses is about 10 degrees.

4. A slideboard in accordance with claim 1 wherein the boot plate has a central bore for receiving a head portion of the central bolt, the head portion being complementary in shape to the bore.

5. A slideboard in accordance with claim 1 including pivotal guides between the board plate and the boot plate, located in at least one of the front and rear regions of the binding, the guides including guide spigots engaging peripheral recesses in the board plate, said peripheral recesses having horizontal bases flanked by obliquely rising side regions, said side regions forming angles of about 20 to 30 degrees with the bases.

6. A slideboard in accordance with claim 1 including pivotal guides between the board plate and the boot plate, located in at least one of the front and rear regions of the binding, the guides including guide spigots engaging peripheral recesses in the board plate, said peripheral recesses having horizontal bases flanked by obliquely rising side regions, said side regions forming angles of about 25 degrees with the bases.

7. A slideboard in accordance with claim 1 including a front slide plate and a rear slide plate mounted on the boot plate and coupled by a right and left hand threaded adjusting screw, the front slide plate including a front boot holding means and the rear slide plate including a rear boot holding means, whereby the front and rear slide plates are jointly and oppositely longitudinally movable relative to the boot plate by turning the adjusting screw.

8. A slideboard comprising a board and first and second bindings for boots with the bindings arranged one behind the other at a substantial angle to the longitudinal axis of the board, each binding including a board plate secured to the board and a boot plate which is movable relative to the board plate and firmly connectable with the boot, resilient tensioning means for resiliently drawing said board plate and said boot plate into firm contact with one another in a front region and a rear region of the binding, said tensioning means being a chosen one of a connection spigot having partly spherical heads at both ends and a connecting link having elongate slots, a pivotal cam arranged in the board plate and resiliently held by said tensioning means, one of said spherical ends and said connecting link ends being pivotally journalled in the boot plate and the other one of said spherical ends and said connecting link ends being pivotally connected to the pivotal cam, said tensioning means generating a resilient force so that an excessive loading of the boat can cause pivoting movements of the boat plate relative to the board plate about an axis perpendicular to the boat plate and tilting movements of the boot plate relative to the board plate in lateral and longitudinal directions about a lateral axis of the board plate and a longitudinal axis substantially perpendicular thereto, respectively.

9. A slideboard in accordance with claim 8 wherein the lateral tilting movement is in the range of about 15 to 45 degrees.

10. A slideboard in accordance with claim 8 wherein the lateral tilting movement is in the range of about 20 to 40 degrees.

11. A slideboard in accordance with claim 8 wherein the lateral tilting movement is in the range of about 25 to 35 degrees.

12. A slideboard in accordance with claim 8 wherein the lateral tilting movement is about 30 degrees.

13. A slideboard in accordance with claim 8 wherein the longitudinal tilting movement is in the range of about 3 to 15 degrees.

14. A slideboard in accordance with claim 8 wherein the longitudinal tilting movement is in the range of about 4 to 10 degrees.

15. A slideboard in accordance with claim 8 wherein the longitudinal tilting movement is about 5 degrees.

16. A slideboard in accordance with claim 8 wherein the pivot angle about the perpendicular axis is about 3 to 15 degrees.

17. A slideboard in accordance with claim 8 wherein the pivot angle about the perpendicular axis is about 4 to 10 degrees.

18. A slideboard in accordance with claim 8 wherein the pivot angle about the perpendicular axis is about 5 degrees.

19. A slideboard in accordance with claim 8 including guide means between the board plate and the boot plate and in at least one of the front and rear regions of the binding, the guide means including a circularly shaped recess in the board plate concentric with the perpendicular axis and guide spigots engaging said recess, the recess having a flat base portion substantially parallel to the board plate and side regions obliquely rising from the base at angles of about 20 to 30 degrees.

20. A slideboard in accordance with claim 19 wherein said side regions obliquely rise from the base at angles of about 25 degrees.

21. A slideboard in accordance with claim 8 including a front slide plate and a rear slide plate movably mounted on the boot plate and coupled by a right and left hand threaded adjusting screw, the front slide plate including a front boot holding means and the rear slide plate including rear boot holding means, whereby the front and rear slide plates are jointly and oppositely longitudinally movable relative to the boot plate and by turning the adjusting screw.

22. A slideboard comprising a board and two bindings for boots with the bindings arranged one behind the other at a substantial angle to the longitudinal axis of the board, each binding including a board plate secured to the board and a boot plate which is moveable relative to the board plate and firmly connectable with the boot, resilient tensioning means for resiliently drawing said board plate into firm contact with one another in a front and rear region of the binding, said tensioning means being a chosen one of a connection spigot with partly spherical heads at both ends and a connecting link with elongate slots, a pivotal cam arranged in the board plate and resiliently held by said tensioning means, one of said spherical ends and connecting link ends being pivotally journalled in the boot plate and the other one of said spherical ends and connecting link ends being pivotally connected to the pivotal cam, and tensioning means generating a resilient force so that an excessive loading of the boot can cause tilting movements of the boot plate relative to the board plate in lateral and longitudinal directions about a lateral axis of the board plate and a longitudinal axis substantially perpendicular thereto, respectively, a circular holding disc secured to the board, a central bolt releasably securing said board plate to said holding disc, the board plate centrally pivotable about a vertical axis and having a ring recess of complementary shape to and accommodating said holding disc, opposing surfaces of the board plate and the holding disc defining cooperating radially oriented projections and recesses at predetermined angular spacings about the vertical axis for locking the board plate with the bolt to the holding disc in a chosen one of predetermined angular positions determined by the cooperating projections and recesses.

23. A slideboard in accordance with claim 22 wherein the boot plate has a central bore for receiving a head portion of the central bolt, the head portion being complementary in shape to the bore.

24. A slideboard in accordance with claim 22 including guide means between the board plate and the boot plate and in at least one of the front and rear regions of the binding, the guide means including a circularly shaped recess in the board plate concentric with the perpendicular axis and guide spigots engaging said recess, the recess having a flat base portion substantially parallel to the board plate and side regions obliquely rising from the base at angles of about 20 to 30 degrees.

25. A slideboard in accordance with claim 22 including a front slide plate and a rear slide plate movably mounted on the boot plate and coupled by a right and left hand threaded adjusting screw, the front slide plate including a front boot holding means and the rear slide plate including rear boot holding means, whereby the front and rear slide plates are jointly and oppositely longitudinally movable relative to the boot plate by turning the adjusting screw.

26. A slideboard in accordance with claim 8 wherein the tensioning means is a chosen one of said connection spigot, said connecting link, and prestressed resilient bands in engagement with the boot plate and the board plate.

27. A slideboard in accordance with claim 22 wherein the tensioning means is a chosen one of said connection spigot, said connecting link, and prestressed resilient bands in engagement with the boot plate and the board plate.

* * * * *